US006833039B2

(12) United States Patent
Andersen et al.

(10) Patent No.: US 6,833,039 B2
(45) Date of Patent: Dec. 21, 2004

(54) FLOOR COVERING WITH BORDERS AND METHOD OF MAKING SAME

(75) Inventors: Soren Andersen, Hornslet (DK); Peter Helge Sorensen, Hornslet (DK); Thomas Brock, Sale (GB)

(73) Assignee: Milliken & Company, Spartenburg, SC (US)

( * ) Notice: Subject to any disclaimer, the term of this patent is extended or adjusted under 35 U.S.C. 154(b) by 440 days.

(21) Appl. No.: 10/001,647

(22) Filed: Nov. 1, 2001

(65) Prior Publication Data

US 2002/0090487 A1 Jul. 11, 2002

(51) Int. Cl.[7] ..... B32B 31/00

(52) U.S. Cl. ..... 156/72; 156/257; 156/259; 156/268; 156/270; 156/271; 156/154; 156/308.2; 156/309.9; 442/304; 428/88; 428/95; 428/96

(58) Field of Search ..... 156/72, 257, 259, 156/268, 271, 270, 153, 154, 308.2, 309.9; 442/304; 428/88, 95, 96

(56) References Cited

U.S. PATENT DOCUMENTS 5,861,044 A 1/1999 Crenshaw ..... 8/115
5,865,933 A 2/1999 Morin et al. ..... 156/272.8
5,885,684 A 3/1999 Hefner et al. ..... 428/89
2001/0044249 A1 * 11/2001 Demott et al. ..... 442/304

FOREIGN PATENT DOCUMENTS

| | | |
|---|---|---|
| GB | 194590 | 5/1922 |
| GB | 768001 | 11/1953 |
| GB | 1564938 | 12/1975 |

* cited by examiner

*Primary Examiner*—Linda Gray
(74) *Attorney, Agent, or Firm*—Terry T. Moyer; Charlotte C. Wilson

(57) ABSTRACT

A mat (10) comprises a pile surface fabric (40) and a rubber or rubber-like backing layer (20). The pile surface fabric (40) is connected to and extends to the edges of the backing layer (20). The pile surface fabric (40) is provided with a border portion (22) having on its upper surface (26) a contrasting color and/or texture to the remainder (24) of the pile surface fabric and extending along at least a portion of the edge of said pile surface fabric. The mat (10) can be formed in a single cutting operation by cutting the mat from a roll of mat material (30) comprising a pile surface fabric having elongate areas (32, 34) of contrasting surface color and/or texture bonded to a rubber backing layer. The cuts (36, 38) are made along the elongate areas (32, 34). Since the border (22) is formed in the pile, colors and shapes can be selected to suit customer requirements, while the mat (10) serves to clean footwear over its entire area.

13 Claims, 2 Drawing Sheets

FLOOR COVERING WITH BORDERS AND METHOD OF MAKING SAME

BACKGROUND

This invention relates generally to floor coverings and mats of the type which have a pile surface on the upper side and a backing layer on the lower side. In particular the invention relates to rubber-backed floor mats such as dust control mats or decorative mats of the type which have a rubber or rubber-like material on the lower side. Mats of this type are generally used in access ways where people tend to brush or scrape their feet in order to prevent carrying of moisture and/or dirt, accumulated on their footwear, into other areas of the premises. Normally these mats are located in areas of high pedestrian traffic, such as doorways.

It is desirable for such mats to have a clearly delineated border, so that users of the mats have a clear visual indication of the edge of the mat. The border also serves to act as a frame to the decoration on the mat, particularly in the cases where mats are provided with a pattern in the form of a logo or advertising. Known mats are formed with a backing layer which has a larger area than the pile layer, so that the backing layer extends beyond the pile layer on each of the four sides, forming a contrasting border which does not have a pile applied to it. It is a disadvantage of such mats that they must be manufactured individually. The backing layer must be trimmed to provide a uniform border all the way around the area of pile. It is a further disadvantage that the border area is effectively a wasted area, since it does not have a pile fabric upon it and can serve no purpose in brushing or cleaning the footwear of users.

SUMMARY

Therefore, it is an object of this invention to provide a mat that has a visually recognisable border, but which has improved cleaning characteristics and can be manufactured without additional trimming of the backing layer.

In accordance with a first aspect of the invention there is provided a mat comprising a pile surface fabric and a rubber or rubber-like backing material connected to said pile surface fabric, wherein both the pile surface fabric and the backing material extend to the edge of the mat, and wherein the pile surface fabric is provided with a border portion having on its upper surface a contrasting colour and/or texture to the remainder of the pile surface fabric and extending along at least a portion of the edge of said pile surface fabric.

It is to be understood that the edge of the mat may comprise a plurality of straight edges or one or more curved edges or a combination of one or more straight edges and one or more curved edges. The edge of the mat is understood to be the side surface of the mat which extends around the perimeter of the mat and connects the upper and lower surfaces of the mat.

It is to be understood that a rubber-like backing material can include a substantially impervious flexible sheet material such as natural or artificial rubber, latex, polyethylene, polyester, polypropylene and polyamide. Preferably the backing material is a solid sheet.

Preferably the border portion of the pile surface fabric extends along the entire perimeter of the pile surface fabric.

Preferably the edge of the mat comprises a cut edge, whereby the cut edge is the result of a single cutting operation through the pile surface fabric and the backing material.

Preferably the backing material is vulcanised to the pile surface fabric.

In the case where the border portion has on its upper surface a contrasting colour, the border portion may comprise a printed portion of the pile surface fabric. Alternatively the border portion may comprise a portion of the pile surface fabric produced using pre-dyed yarns. Alternatively the border portion may comprise a portion of the pile surface fabric produced by selective melting of the yarns in the pile surface fabric. Alternatively the border portion may comprise a portion of the pile surface fabric screened from a printing or dyeing process applied to the remainder of the pile surface fabric by selective application of a liquid repellent to the border portion.

In the case where the border portion has on its upper surface a contrasting texture, the border portion may comprise a portion of the pile surface fabric having reduced pile height produced by selective melting, mechanical carving or chemical treatment of the yarns in the pile surface fabric.

In accordance with a second aspect of the invention there is provided a method for manufacturing a mat comprising a pile surface fabric and a rubber or rubber-like backing material connected to said pile surface fabric, comprising the steps of:

bonding a pile surface fabric to a rubber or rubber-like backing material, the pile surface fabric having elongate areas of contrasting surface colour and/or texture, cutting through the pile surface fabric and backing material along at least one of said elongate areas to form a mat, wherein the cut portion of the elongate area forms a border portion of the mat.

Preferably the pile surface fabric has longitudinal and transverse elongate areas of contrasting surface colour and/or texture forming a grid on the pile surface fabric. Preferably the pile surface fabric and backing material are cut along two longitudinal and two transverse elongate areas to form a substantially rectangular mat.

Preferably the bonding step is achieved by vulcanization of the rubber backing layer to the fabric.

In a preferred embodiment the method includes the step of using a visual scanning means, such as a sensor array or a camera, to scan the pile surface fabric and identify the position of the elongate areas. Alternatively the method includes the step of using a mechanical guide sensor, to identify the position of the elongate areas in the case when the elongate areas are sculpted or carved, by physically sensing the change in height of the pile surface fabric.

Preferably the method also includes the step of using an electronic control means to guide a cutting means to cut through the pile surface fabric and backing material along a cutting line having a predefined position with respect to the position of the elongate area. Preferably the cutting line is predefined as corresponding to the centre line of the elongate area.

In a first preferred embodiment the areas of contrasting surface colour and/or texture are areas of contrasting surface colour. The areas of contrasting colour may be achieved by the step of printing or dyeing the pile surface fabric, either before or after the bonding step. Alternatively the areas of contrasting colour may be achieved by forming the pile surface fabric with areas which comprise pre-dyed yarns.

Alternatively the areas of contrasting colour may be achieved by the step of selective application of heat on the pile surface fabric, wherein the fabric comprises a blend of fibres of polymers having different melting points, either before or after the bonding step. A suitable method of selective application of heat is described in U.S. Pat. No. 5,865,933.

Alternatively the areas of contrasting colour may be achieved by the step of selective application of chemicals containing a liquid repellent on the pile surface fabric, wherein the fabric is subsequently rewetted by the application of liquid and subject to heat treatment to carve the areas to which liquid repellent has been applied, either before or after the bonding step. A suitable method of selective application of liquid repellent and heat treatment is described in U.S. Pat. No. 5,861,044.

Alternatively the areas of contrasting colour may be achieved by the step of selective application of chemicals to carve the upper surface of the pile surface fabric and reveal a lower portion of the pile surface fabric having a contrasting colour to the colour of the fibres at the upper surface of the pile surface fabric.

In a second preferred embodiment the areas of contrasting surface colour and/or texture are areas of contrasting surface texture. The areas of contrasting texture may be achieved by the step of selectively carving areas of the pile surface fabric, either before or after the bonding step. The carving may be carried out by acid carving, mechanical carving or shearing.

The carving may be carried out by applying a degrading agent to the pile fibres in the area to be carved, heating the pile fabric to cause degradation of the pile fibres and mechanically removing the degraded fibres. Suitable methods of degrading the fibres are described in U.S. Pat. Nos. 4,415,331 and 4,353,706.

Alternatively the carving may be carried out by the step of selective application of chemicals containing a liquid repellent on the pile surface fabric, wherein the fabric is subsequently rewetted by the application of liquid and subject to heat treatment to carve the areas to which liquid repellent has been applied, either before or after the bonding step. A suitable method of selective application of liquid repellent and heat treatment is described in U.S. Pat. No. 5,861,044.

Other objects and advantages of the invention will become readily apparent from the following description of the invention with reference to the accompanying drawings, in which:

DETAILED DESCRIPTION OF THE PREFERRED EMBODIMENT

Figure 1:
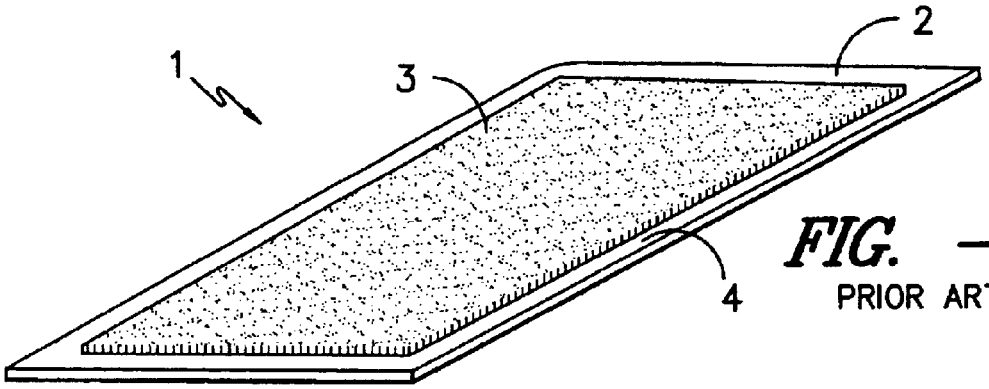
FIG. -1- PRIOR ART
FIG. 1 is a perspective view of a known dust control mat.
Figure 2:
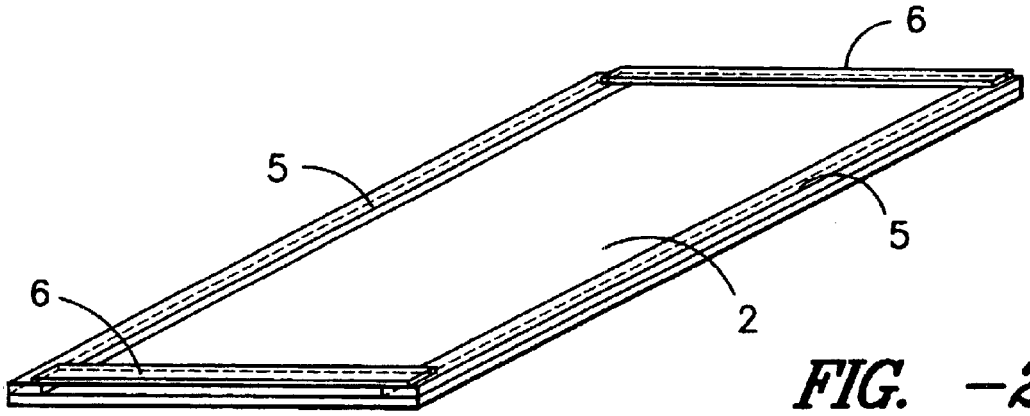
FIG. -2- PRIOR ART
FIG. 2 is a perspective view on the rubber backing sheet and rubber strips of a prior art dust control mat before placement of the pile fabric layer.
Figure 3:
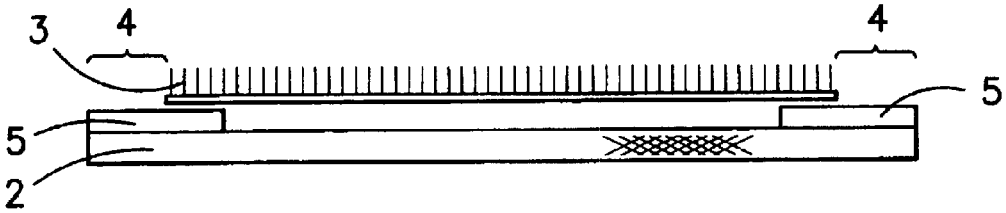
FIG. -3- PRIOR ART
FIG. 3 is a section through the prior art mat of FIG. 2 after placement of the pile fabric layer.

Referring to FIGS. 1 to 3 there is shown a prior art dust control mat 1 comprising a rubber backing sheet 2 onto which is bonded a pile surface fabric layer 3. The backing sheet 2 projects on each side beyond the pile layer 3 to form a border 4. Manufacture of prior art mats is as follows. First the mat pile is manufactured in a continuous length on a tufting machine and is then passed through a dyeing machine to colour the mat pile. The continuous coloured pile is then cut to size to form the individual pile surface fabric layers 3. The rubber backing layer is fed from a continuous roll to a cutting station where it is cut to size to form individual rubber backing sheets 2. Each mat is assembled by placing a pile surface fabric layer 3 centrally on a rubber backing sheet 2 and feeding the assembled mat through a vulcanizing machine to bond the fabric 3 to the backing sheet 2. The edges may be further trimmed to complete the mat manufacture.

As shown in FIG. 2, rubber strips 5, 6 may be used to reinforce the borders 4 of the mat, particularly in cases where a thin rubber backing layer 2 is used to reduce the weight of the mat 1 and improve handling. These rubber strips make the assembly of the mat more complicated. Indeed the manufacture of a single mat can involve the assembly of up to 20 separate pieces.

Figure 4:
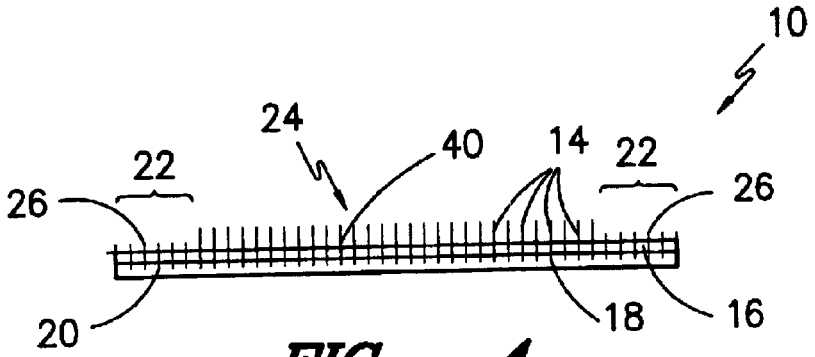
FIG. 4 is a perspective view on a mat according to an embodiment of the present invention.
Figure 5:
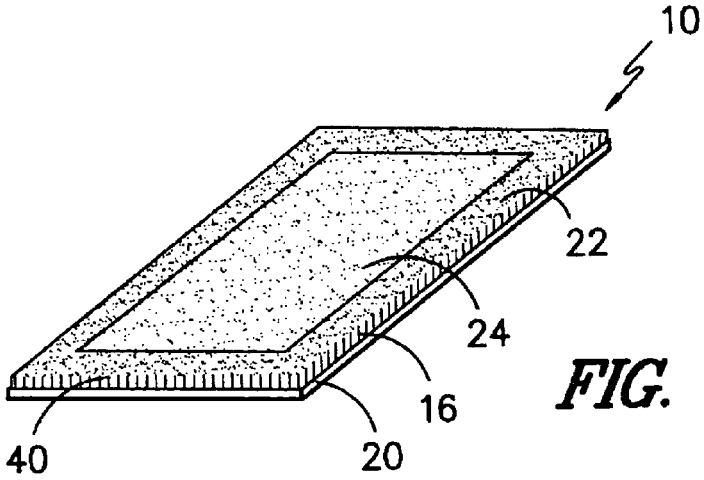
FIG. 5 is a sectional view through the mat of FIG. 4.

FIGS. 4 and 5 show a mat according to the present invention. In the preferred form of the invention the mat 10 consists of a pile surface fabric 40 comprising pile yarns 14 of cotton, polyester, or any suitable yarn tufted through a woven or nonwoven substrate 16 of suitable material. The lower parts 18 of the tufts of pile yarn 14 are adhered to the rubber or rubber-like backing material 20 during vulcanization. The effect of a border is achieved by the fact that a border portion 22 of the pile surface fabric 14 has a colour which contrasts with the colour of the central portion 24 of the pile surface fabric 14. Typically the colour of the border portion 22 may be black or a dark colour, to mimic the black rubber border of a conventional dust control mat, while the colour of the central portion 24 may be a lighter colour. The effect of the border may be accentuated by sculpting the upper surface 26 of the tufts of the border 22, as shown in FIG. 5. Alternatively the effect of the border may be achieved solely by sculpting the upper surface 26, so that the border 22 is visible through the effect of shadow from the raised central area 24 of tufts 14 and/or the effect produced by the fact that the dark backing layer 20 is more visible through the shorter tufts 14 in the border 22.

It should be noted that the combination of tufts 14 and substrate 16 may be replaced by a single pile fabric layer (not shown) if required. The single pile fabric layer is bonded directly to the rubber backing layer 20 by vulcanization.

The contrasting colour of the border 22 may be achieved in any suitable manner. For example, the border may be printed with a dye, or the border may be made using yarn of a different colour to the yarn used in the central area 24.

A preferred method of forming the border with a contrasting colour is the carving method described in U.S. Pat. No. 5,865,933. The pile fabric 40 is formed of a blend of fibres of two different polymers. The first polymer has a first colour, while the second polymer has a second colour. The melting point of the first fibres exceeds that of the second fibres. When heat is applied to the area of the pile fabric 40 which will form the border 22, to a temperature which exceeds the melting point of the second fibres but does not exceed that of the first fibres, the second fibres melt away, leaving the colour of the first fibres dominating. In the remaining areas 24 in which heat is not applied, the resulting colour is a blend of the first and second colours. The heat may of course instead be applied only to the area 24 which will not form the border 22, to reverse the colours.

A further method of carving the border area 22 is the carving method described in U.S. Pat. No. 5,861,044. Chemicals containing a liquid repellent either alone or with other chemicals such as dye are applied to the areas of the pile fabric 40 which will form the border 22. The entire pile fabric 40 is then rewetted by the application of liquid. The printed area 22 containing repellent remains dry and the areas 24 without repellent are wetted out. The pile fabric 40 is then subjected to pressurized heated gas which selectively carves the dry areas 22 leaving the wetted areas protected and uncarved. The repellent may of course instead be applied only to the area 24 which will not form the border 22, to reverse the carving and/or dyeing.

Figure 6:
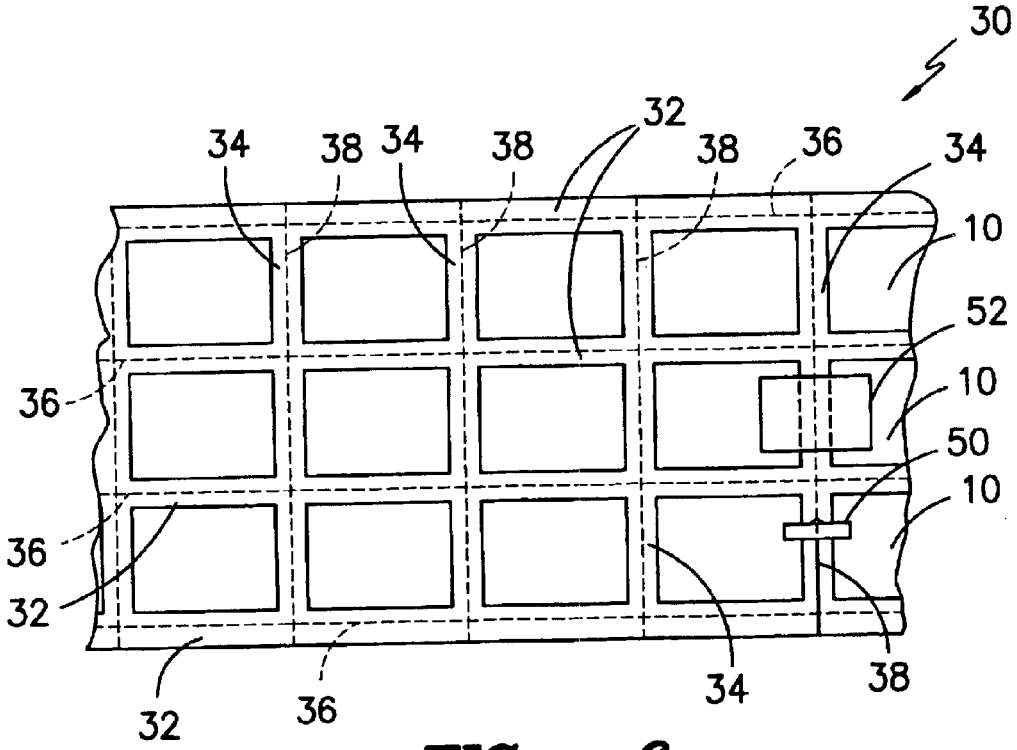
FIG. 6 is a plan view on a sheet of mat material used in the method of manufacture according to an embodiment of the present invention.

FIG. 6 shows a plan view on a sheet 30 of mat material used in the method of manufacture of mats 10 according to the present invention. The sheet material is produced by bonding a continuous sheet of pile fabric material 40, with or without a fabric substrate 16, to a continuous sheet of rubber backing material 20 by vulcanization. The top surface of the pile fabric material is marked with elongate areas in the form of longitudinal strips 32 and transverse strips 34 which are intended to form the border areas 22 of the finished mats 10. The longitudinal and transverse strips 32 and 34 form a grid pattern on the pile fabric 40. The strips 32 and 34 may be coloured or carved in any of the methods described above, for example by printing, dyeing, using yarns of different colours to make the pile fabric, acid treatment, heat treatment etc. The colouring or carving may take place before or after bonding the pile fabric 40 to the backing layer 20.

The individual mats are then produced by cutting along longitudinal 36 and transverse 38 cut lines by any suitable cutting means. Preferably the sheet 30 is transported to a scanning and cutting station, where a visual scanning means such as a scanning array sensor 52 is used to recognise the longitudinal and transverse strips 32 and 34 and to guide a cutting apparatus, such as a laser cutter (not shown) or a cutting blade 50, along the cut lines 36 and 38 whose positions are calculated by an electronic control means (eg microprocessor, not shown) based on the measured position of the strips 32 and 34. Alternatively a mechanical guide sensor can be used to identify the position of the strips 32, 34 when the strips are sculpted or carved, by physically sensing the change in height of the pile surface fabric. Such scanning and cutting apparatus is known in the art and is not described further here.

The electronic control means guides the cutting means 52 to cut through the pile surface fabric 40 and backing material 20 along a cutting line 36, 38 which has a predefined position with respect to the position of the strips 32, 34. The cutting line 36, 38 may be predefined as corresponding to the centre line of the strip 32, 34, or may be predefined as being a predetermined distance from the edge of the strip 32, 34. Each cut line 36, 38 corresponds to a portion of an edge of at least one mat 10.

Preferably the bonding of the pile layer 40 and backing layer 20 to form a single bonded sheet 30, the printing and/or carving of the border strips 32, 34 and the cutting of the single bonded sheet 30 along the cut lines 36, 38 to form a plurality of individual mats 10 takes place as a continuous process, with the pile layer 40 and backing layer 20 fed from a roll or rolls at a first end of the production line and the individual mats stacked or rolled at a second end of the production line.

The mats produced according to the invention have flush edges, with the pile yarns 14 extending to the edge of the mat 10, giving rise to several advantages. The colours of both the border 22 and the main body 24 of the mat may be selected to suit the customer's requirements. The mats are produced in a single cutting operation, instead of the several separate cutting and fixing operations of the prior art, making them economical to produce. The mats serve to clean footwear over their entire area, since even the borders are provided with a pile fabric.

It is to be understood that the borders produced in the mat according to the invention can have a contrasting colour, a contrasting pile height or both contrasting colour and contrasting pile height when compared to the main body of the mat.

It is to be understood that the mat described above is a rectangular mat, but that the invention is not limited to rectangular mats, but includes mats of any polygonal or other shape which may be manufactured by an automated manufacturing process, for example square mats, triangular mats, hexagonal mats, circular mats, oval mats and mats having rounded or chamfered corners.

Although the preferred embodiment of the invention has been described, it is contemplated that many changes may be made without departing from the scope or spirit of the claims and it is desired that the invention be limited only by the claims.

What is claimed is:

1. A method of manufacturing a mat comprising a pile surface fabric and a rubber backing material connected to said pile surface fabric, comprising the steps of:

a. bonding a pile surface fabric to a rubber backing material, the pile surface fabric having elongate, visually distinctive areas of contrasting surface appearance, and b. cutting through the pile surface fabric and backing material along at least one of the elongate areas to form a mat, wherein the cut portion of the elongate area forms a border portion of the mat.

2. The method according to claim 1, wherein the pile surface fabric has longitudinal and transverse elongate, visually distinctive areas of contrasting surface appearance forming a grid on the pile surface fabric.

3. The method according to claim 2, wherein the pile surface fabric and backing material are cut along two longitudinal and two transverse elongate areas to form a substantially rectangular mat.

4. The method according to claim 1, wherein the bonding step is achieved by vulcanization of the rubber backing layer to the pile surface fabric.

5. The method according to claim 1, wherein the method includes the step of using a visual scanning means to scan the pile surface fabric and identify the position of the elongate areas.

6. The method according to claim 1, wherein the method includes the step of using a mechanical guide sensor to identify the position of the elongate areas when the elongate areas are of distinctive heights, by physically sensing the distinction in height.

7. The method according to claim 5, wherein the method also includes the step of using an electronic control means to guide a cutting means to cut through the pile surface fabric and backing material along a cutting line having a predefined position with respect to the position of the elongate area.

8. The method according to claim 6, wherein the method also includes the step of using an electronic control means to guide a cutting means to cut through the pile surface fabric and backing material along a cutting line having a predefined position with respect to the position of the elongate area.

9. A method according to claim 1, wherein the elongate, visually distinctive areas are areas of contrasting surface colour, the areas of contrasting surface colour being achieved by a method step selected from the group consisting of:

dyeing the pile surface fabric;

forming the pile surface fabric with areas which comprise pre-dyed yarns;

selectively applying heat on the pile surface fabric, wherein the pile surface fabric comprises a blend of fibers of polymers having different melting points;

selectively applying chemicals containing a liquid repellent on the pile surface fabric, wherein the pile surface fabric is rewetted by the application of liquid and subjected to heat treatment to carve the areas to which the liquid was applied; and selectively applying chemicals to carve the upper surface of the pile surface fabric and reveal a lower portion of the pile surface fabric having a contrasting color to the color of the fibres at the upper surface of the pile fabric.

10. The method according to claim 1, wherein the elongate, visually distinctive areas are areas of contrasting surface texture, the areas of contrasting texture being achieved by the step of selectively carving areas of the pile surface fabric.

11. The method according to claim 10, wherein the carving is carried out by a process selected from the group consisting of acid carving, mechanical carving and shearing.

12. The method according to claim 10, wherein the carving is carried out by applying a degrading agent to the pile fibers in the area to be carved, heating the pile fabric to cause degradation of the pile fibers, and mechanically removing the degraded fibers.

13. The method according to claim 10, wherein the carving is carried out by the step of selective application of chemicals containing a liquid repellent on the pile surface fabric, wherein the fabric is subsequently rewetted by the application of liquid and subjected to heat treatment to carve the areas to which liquid repellent has been applied.

* * * * *